US007682289B2

(12) United States Patent
Chen

(10) Patent No.: US 7,682,289 B2
(45) Date of Patent: Mar. 23, 2010

(54) ADDUCTOR EXERCISER

(76) Inventor: Chih-Liang Chen, No. 66, Alley 71, Lane 252, Sec. 2, Jieshou Rd., Pateh City, Taoyuan Hsien (TW)

( * ) Notice: Subject to any disclaimer, the term of this patent is extended or adjusted under 35 U.S.C. 154(b) by 0 days.

(21) Appl. No.: 11/971,023

(22) Filed: Jan. 8, 2008

(65) Prior Publication Data

US 2009/0176623 A1 Jul. 9, 2009

(51) Int. Cl.
*A63B 22/00* (2006.01)

(52) U.S. Cl. ..... 482/51; 482/71; 482/907

(58) Field of Classification Search ..... 482/51–53, 482/57, 70–71, 79–80, 907, 146, 147; D21/668, D21/670; 74/560, 594.1, 594.3, 594.4, 594.7, 74/600; 601/23, 27–31, 36
See application file for complete search history.

(56) References Cited

U.S. PATENT DOCUMENTS 4,376,532 A * 3/1983 Hunstad ..... 482/71
4,781,372 A * 11/1988 McCormack ..... 482/70
5,000,443 A * 3/1991 Dalebout et al. ..... 482/51
5,518,470 A * 5/1996 Piaget et al. ..... 482/51
5,575,739 A * 11/1996 Piaget et al. ..... 482/51
5,720,698 A * 2/1998 Dalebout et al. ..... 482/52
5,733,226 A * 3/1998 Chen ..... 482/52
5,746,683 A * 5/1998 Lee ..... 482/57
5,823,917 A * 10/1998 Chen ..... 482/57
5,904,641 A * 5/1999 Huang ..... 482/131
5,906,561 A * 5/1999 Lin ..... 482/52
5,928,114 A * 7/1999 Chen ..... 482/57
5,971,892 A * 10/1999 Lee ..... 482/52
5,976,060 A * 11/1999 Nunez ..... 482/52
6,030,319 A * 2/2000 Wu ..... 482/51
6,036,622 A * 3/2000 Gordon ..... 482/51
6,042,510 A * 3/2000 Miller ..... 482/51
6,102,833 A * 8/2000 Chen ..... 482/53
6,117,052 A * 9/2000 Frost et al. ..... 482/52
6,132,339 A * 10/2000 Wang et al. ..... 482/53
6,135,923 A * 10/2000 Stearns et al. ..... 482/51
6,220,990 B1 * 4/2001 Crivello ..... 482/51
6,296,597 B1 * 10/2001 Schone et al. ..... 482/111
6,368,254 B1 * 4/2002 Wall ..... 482/71
6,514,180 B1 * 2/2003 Rawls ..... 482/70
6,719,665 B1 * 4/2004 Lai ..... 482/52
6,814,690 B1 * 11/2004 Stearns ..... 482/52
7,014,595 B2 * 3/2006 Bruno ..... 482/51
7,108,638 B2 * 9/2006 Snyderman ..... 482/57
7,115,073 B2 * 10/2006 Nizamuddin ..... 482/51
7,226,390 B2 * 6/2007 Stearns ..... 482/52

(Continued)

FOREIGN PATENT DOCUMENTS

WO WO 9102566 A1 * 3/1991

*Primary Examiner*—Loan H Thanh
*Assistant Examiner*—Daniel F Roland
(74) *Attorney, Agent, or Firm*—Hershkovitz & Associates, LLC; Abraham Hershkovitz

(57) ABSTRACT

An adductor exerciser has a stanchion, a stand, a crossbar and two legs. The stanchion has an upper end and a lower end. The stand is attached to the lower end. The crossbar is attached to the upper end of the stanchion. Each leg is pivotally connected to the crossbar and has a distal end and a pedal assembly. The pedal assembly is mounted rotatably to the distal end of the leg.

13 Claims, 14 Drawing Sheets

U.S. PATENT DOCUMENTS

| | | | | |
|---|---|---|---|---|
| 7,264,576 | B2 * | 9/2007 | Gerschefske et al. | 482/52 |
| 7,300,387 | B2 * | 11/2007 | Wang | 482/52 |
| 7,425,189 | B1 * | 9/2008 | Eschenbach | 482/52 |
| 2003/0096676 | A1 * | 5/2003 | Chen | 482/51 |
| 2005/0079956 | A1 * | 4/2005 | Bruno | 482/51 |
| 2005/0079957 | A1 * | 4/2005 | Bowman et al. | 482/51 |
| 2007/0135267 | A1 * | 6/2007 | Wang | 482/52 |
| 2008/0020902 | A1 * | 1/2008 | Arnold | 482/51 |
| 2008/0161166 | A1 * | 7/2008 | Lo | 482/52 |
| 2008/0167163 | A9 * | 7/2008 | Dalebout et al. | 482/52 |
| 2008/0207406 | A1 * | 8/2008 | Tsai | 482/52 |
| 2008/0214362 | A1 * | 9/2008 | Eschenbach | 482/52 |
| 2008/0214363 | A1 * | 9/2008 | Eschenbach | 482/52 |
| 2008/0312050 | A1 * | 12/2008 | Chuang et al. | 482/70 |
| 2008/0318738 | A1 * | 12/2008 | Chen | 482/57 |
| 2009/0011904 | A1 * | 1/2009 | Chuang et al. | 482/52 |
| 2009/0049950 | A1 * | 2/2009 | Chen | 74/594.4 |

* cited by examiner

ADDUCTOR EXERCISER

BACKGROUND OF THE INVENTION

1. Field of the Invention

The present invention relates to an adductor exerciser, especially to an adductor exerciser with legs.

2. Description of the Prior Art

Adductor muscles are a muscle group located around the groin and allow a person to open and close their legs. Additionally, the adductor muscles are used in sports for turning, pushing, changing direction and kicking. Therefore, sports people must train the adductor muscles, especially for, but not limited to soccer, football, dancing, martial arts, skating and gymnastics. When not trained the adductor muscles become loose and fatty tissue builds up, so many women especially want to focus on the adductor muscles for vanity.

Therefore, calisthentic exercises may be performed to focus on the adductor muscles, but these exercises must be performed properly, preferably under trained instruction and for long periods. Therefore, people who wish to focus just on adductor muscles have to perform a whole routine with cardiovascular benefits.

Since many people cannot afford a personal trainer to monitor their movement, conventional adductor machines have been taught and may comprise a chair, two arms and a weight block. The arms are transversely mounted pivotally on the chair. The weight block is connected to the arms. A user sits in the chair and spreads their legs open to pull the weight block up to provide resistance, or open their legs and pull their legs together to pull the weight block up and provide resistance. Therefore, many people find the conventional adductor machines embarrassing to use. Moreover, the conventional adductor machine provides no cardiovascular benefit. Since adductor machines are embarrassing to use, people prefer to perform adductor exercise at home. However, the conventional adductor machines are too large and expensive for most people's homes. Moreover, calistentic exercise is time consuming and requires training and supervision. To overcome the shortcomings, the present invention provides an adductor exerciser to mitigate or obviate the aforementioned problems.

SUMMARY OF THE INVENTION

The main objective of the invention is to provide an adductor exerciser.

The adductor exerciser in accordance with the present invention has a stanchion, a stand, a crossbar and two legs.

The stanchion has an upper end and a lower end. The stand is attached to the lower end. The crossbar is attached to the upper end of the stanchion. Each leg is pivotally connected to the crossbar and has a distal end and a pedal assembly. The pedal assembly is attached to the distal end of the leg.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
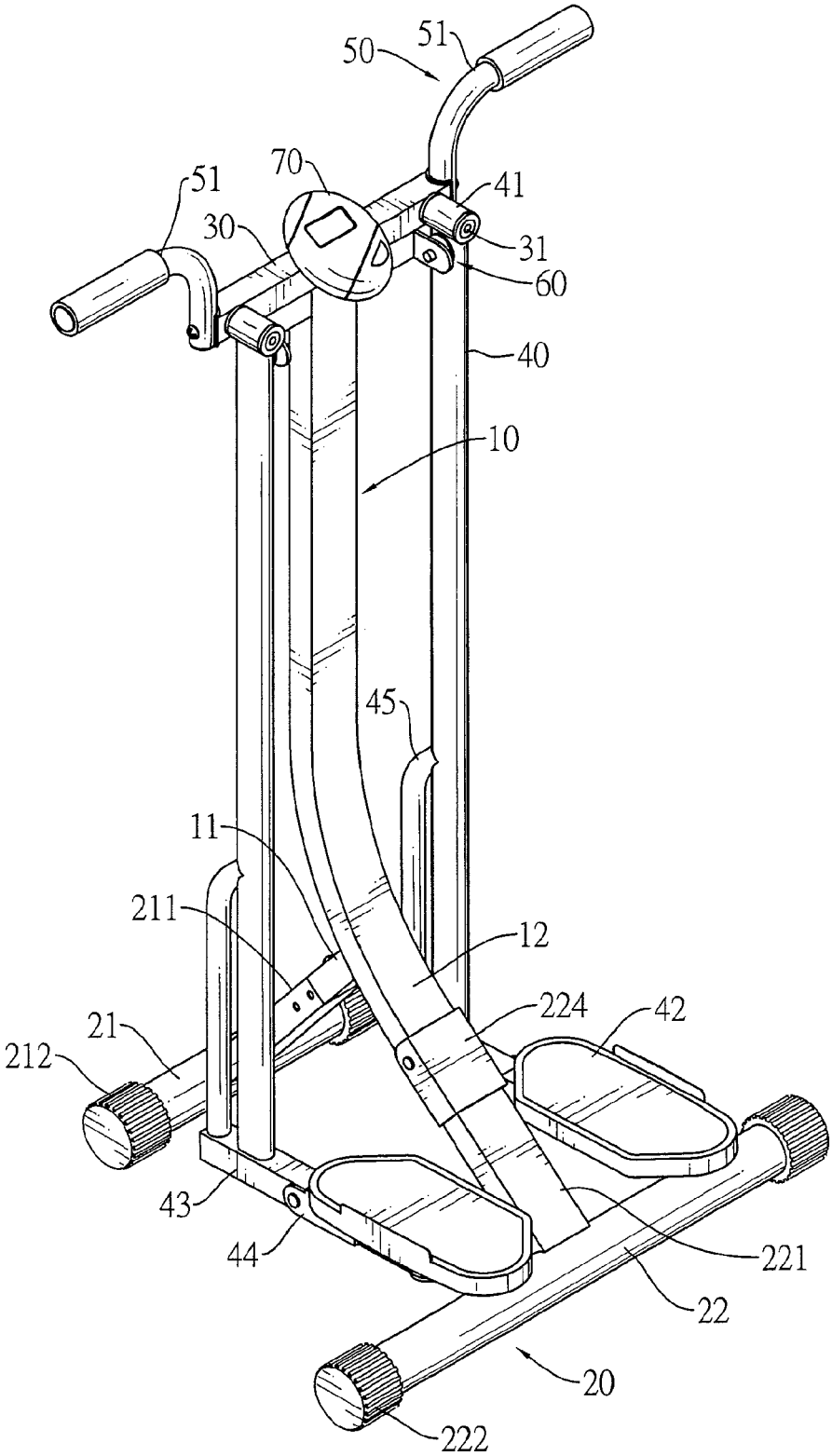
FIG. 1 is a perspective view of an adductor exerciser in accordance with the present invention.
Figure 2:
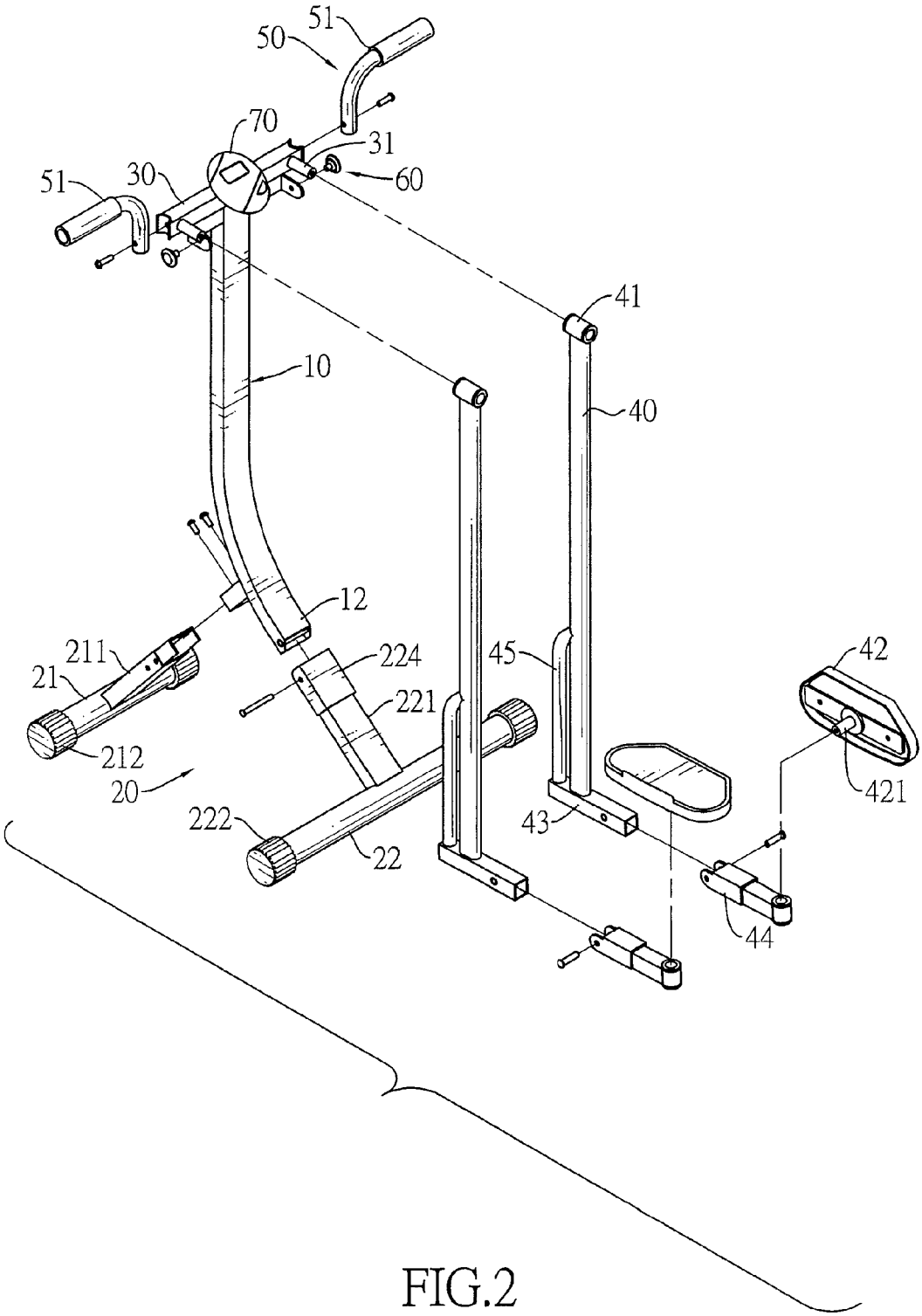
FIG. 2 is an exploded perspective view of the adductor exerciser in FIG. 1.

With reference to FIGS. 1 and 2, an adductor exerciser in accordance with the present invention has a stanchion (10), a stand (20), a crossbar (30), two legs (40), two handles (50), two bumpers (60) and a computer (70).

Figure 9:
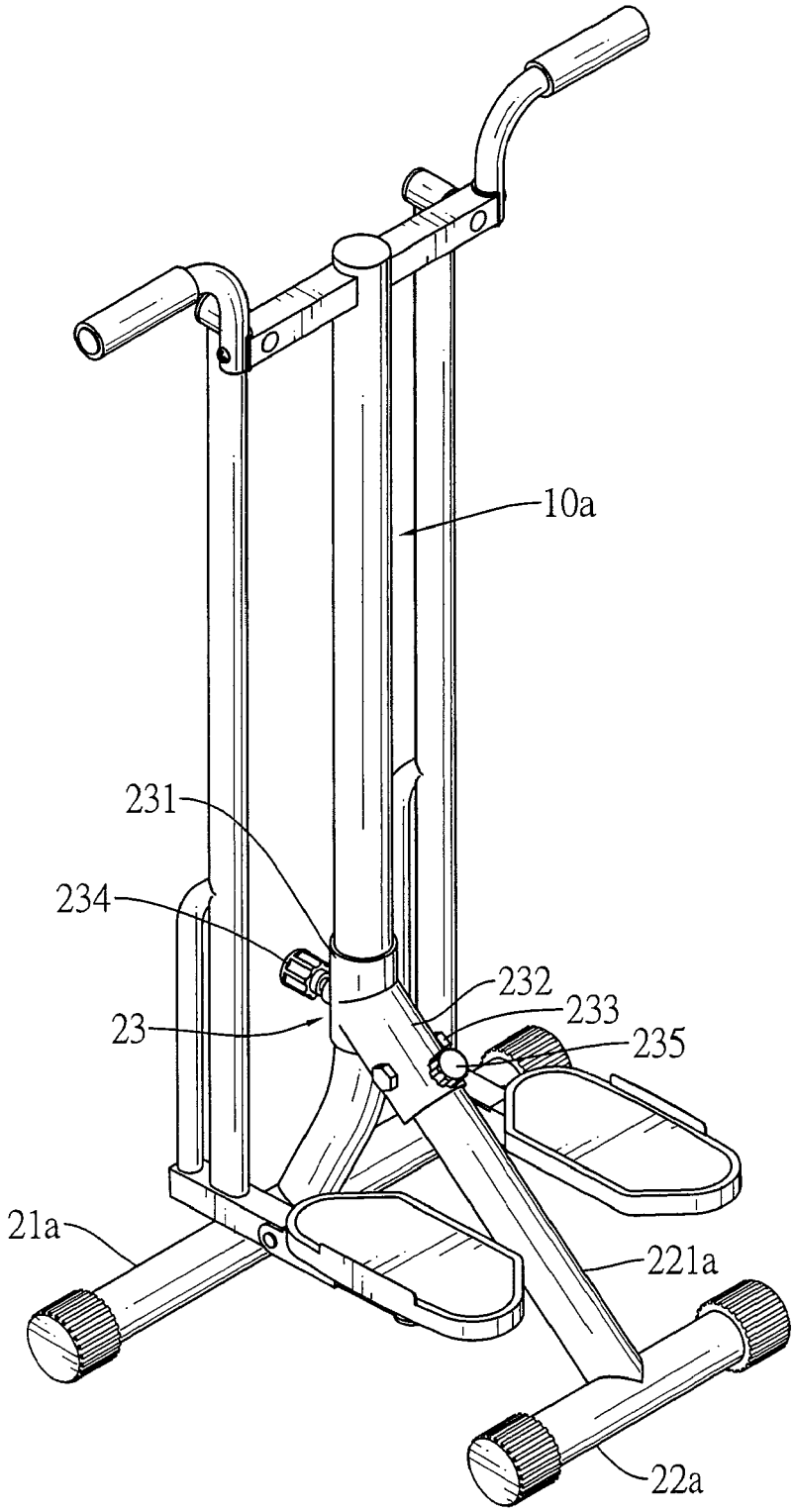
FIG. 9 is a perspective view of a second embodiment of an adductor exerciser in accordance with the present invention.
Figure 10:
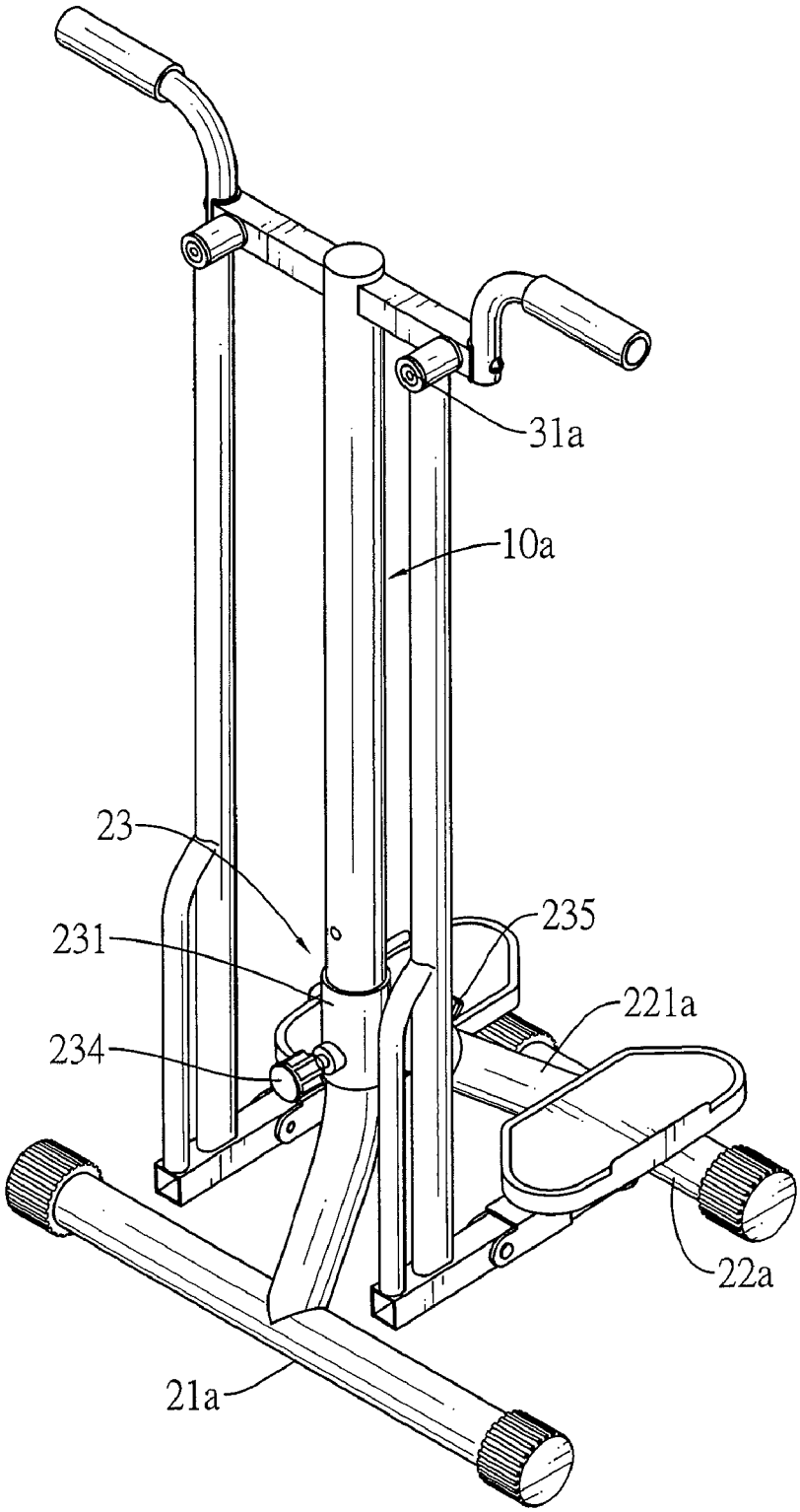
FIG. 10 is another perspective view of the adductor exerciser in FIG. 9.

The stanchion (10) may be a hollow tube and has an upper end, a lower end and may fork into two mounting protrusions (11, 12). The mounting protrusions (11, 12) are formed on and protrude from the lower end of the stanchion (10) and have a lower end. With further reference to FIGS. 9 and 10, the stanchion (10*a*) may be a cylinder or a circular tube.

The stand (20) is attached to the lower end of the stanchion (10), is used to support the stanchion (10) and may comprise at least two feet (21).

The feet (21) are tubes connected to the lower end of the stanchion (10) to hold the stanchion (10) upright, may be connected to the mounting protrusions (11, 12), may be connected pivotally to the mounting protrusions (11, 12), may be mounted inside the mounting protrusions (11, 12) and each foot (21) has two contact ends, a mounting end (221), two caps (212, 222) and may be substantially T-shaped. The mounting end (221) is connected to a corresponding protrusion (12). The caps (212, 222) are mounted respectively on the contact ends of the foot (21, 22). By being connected pivotally, the feet (21) may be folded for compact and convenient storage. With further reference to FIGS. 9 and 10, a second embodiment of the foot (21*a*) extends from the lower end of the stanchion (10*a*) and forms an angle relative to the stanchion (10*a*). The second embodiment renders a foot (21*a*) being formed at one of two forking mounting protrusions at the lower end of the stanchion (10*a*).

The mounting end (221) may have a joint cover (224). The joint cover (224) is pivotally attached to the mounting protrusion (12) and has a first end and a second end. The first end is attached to the mounting end (221). The second end is pivotally connected to the mounting protrusion (12).

The joint cover (224) is used to form a bendable joint between the mounting protrusion (12) and the proximal end allowing the mounting end (221) and the foot (22) to be folded toward the other foot (21) for convenient storage.

Figure 11:
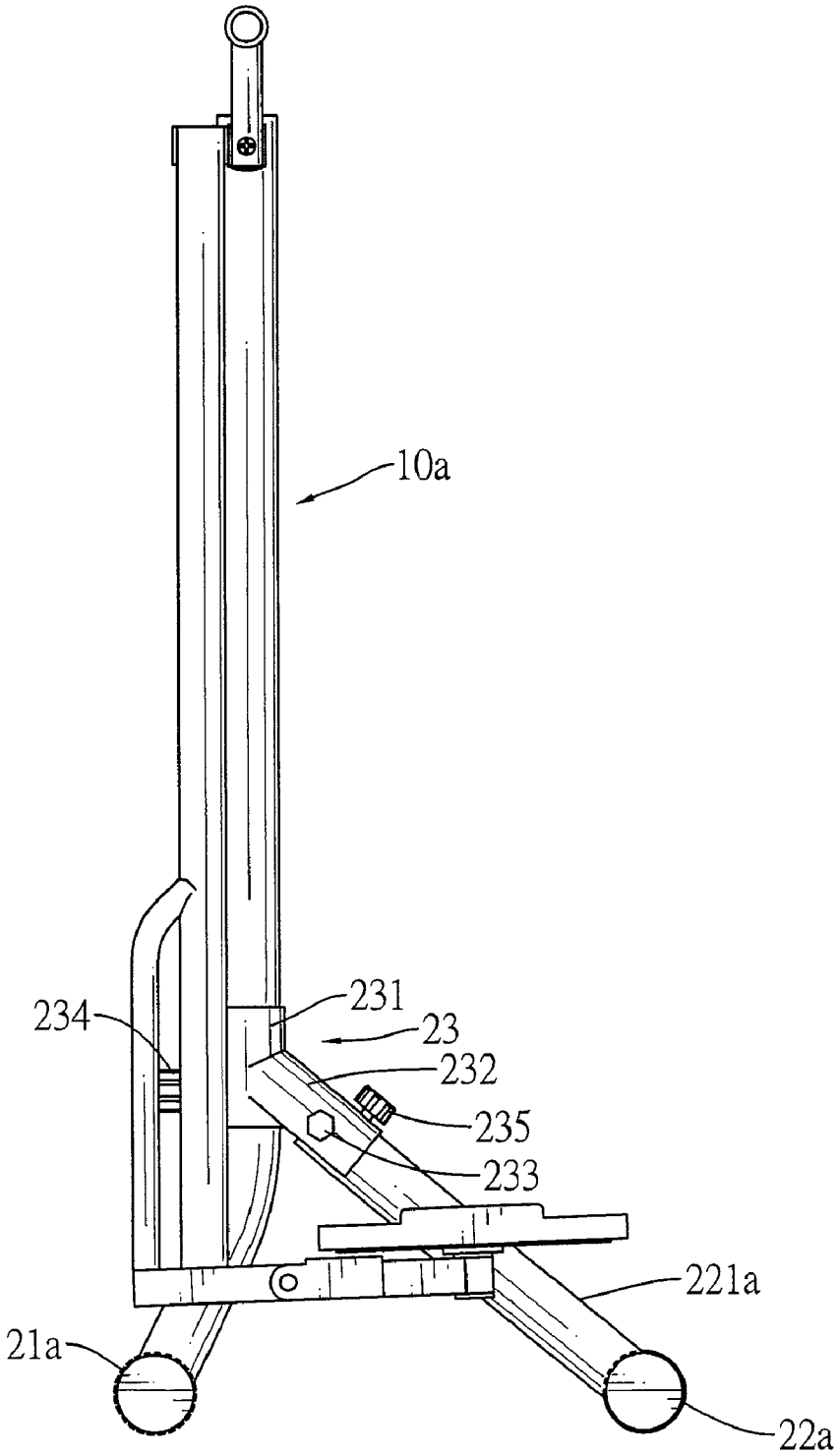
FIG. 11 is a side view of the adductor exerciser in FIG. 10.
Figure 12:
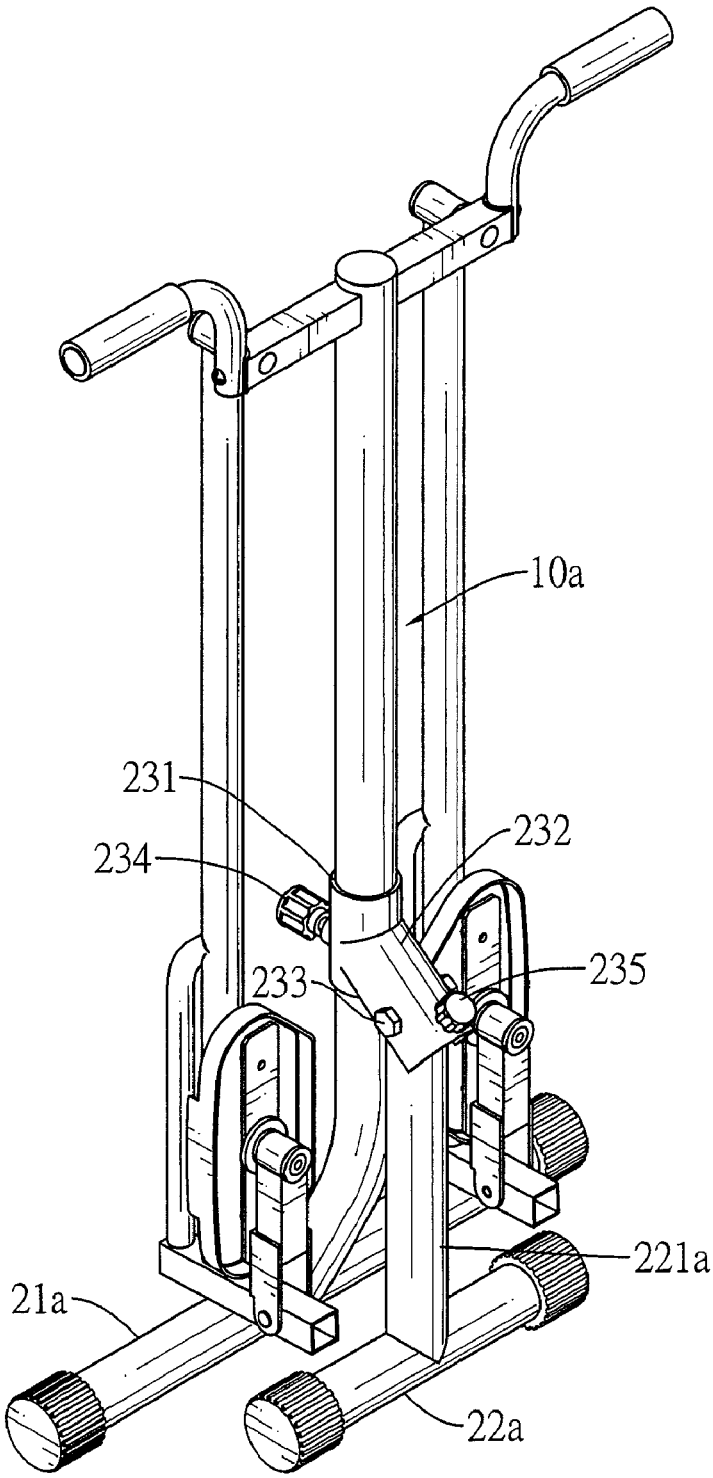
FIG. 12 is a perspective view of the adductor exerciser in FIG. 1, shown folded.
Figure 13:
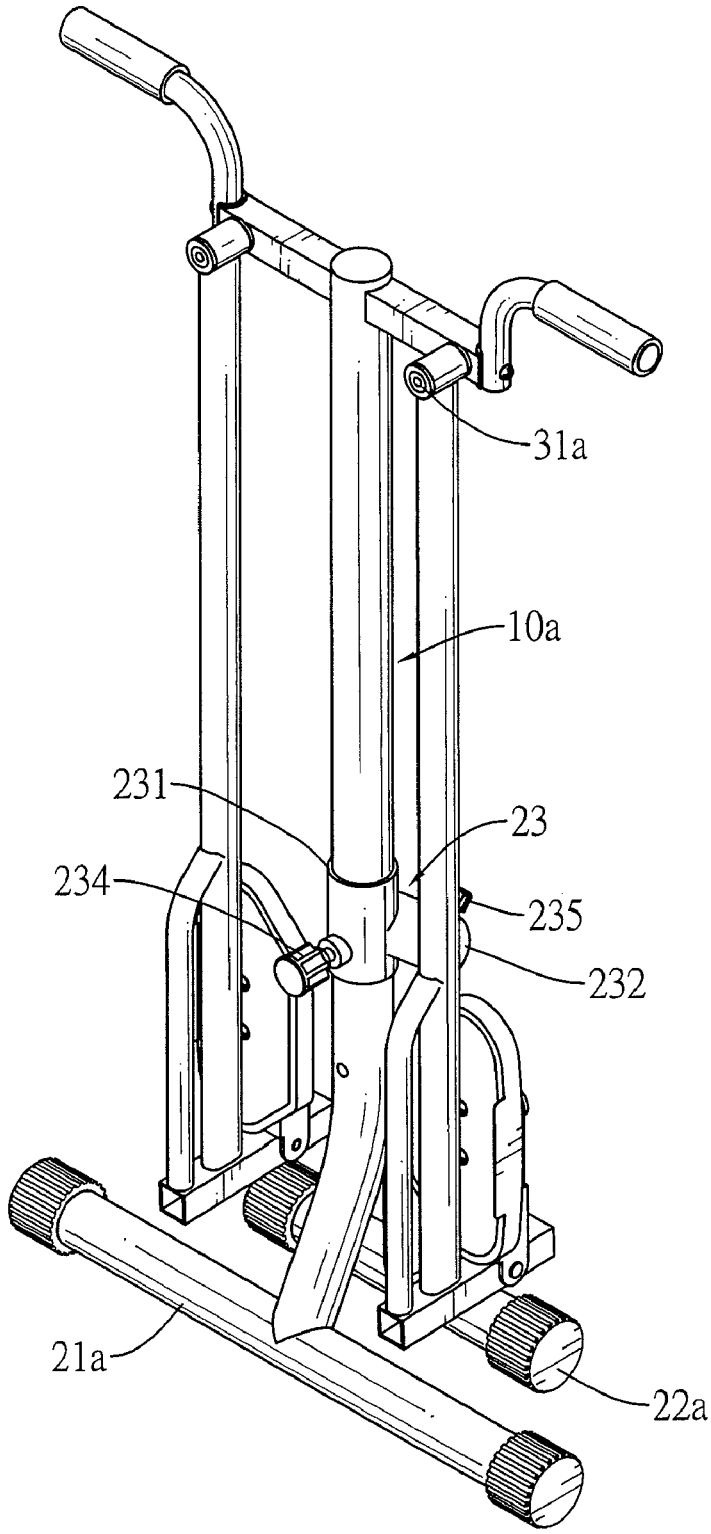
FIG. 13 is another perspective view of the adductor exerciser in FIG. 12.
Figure 14:
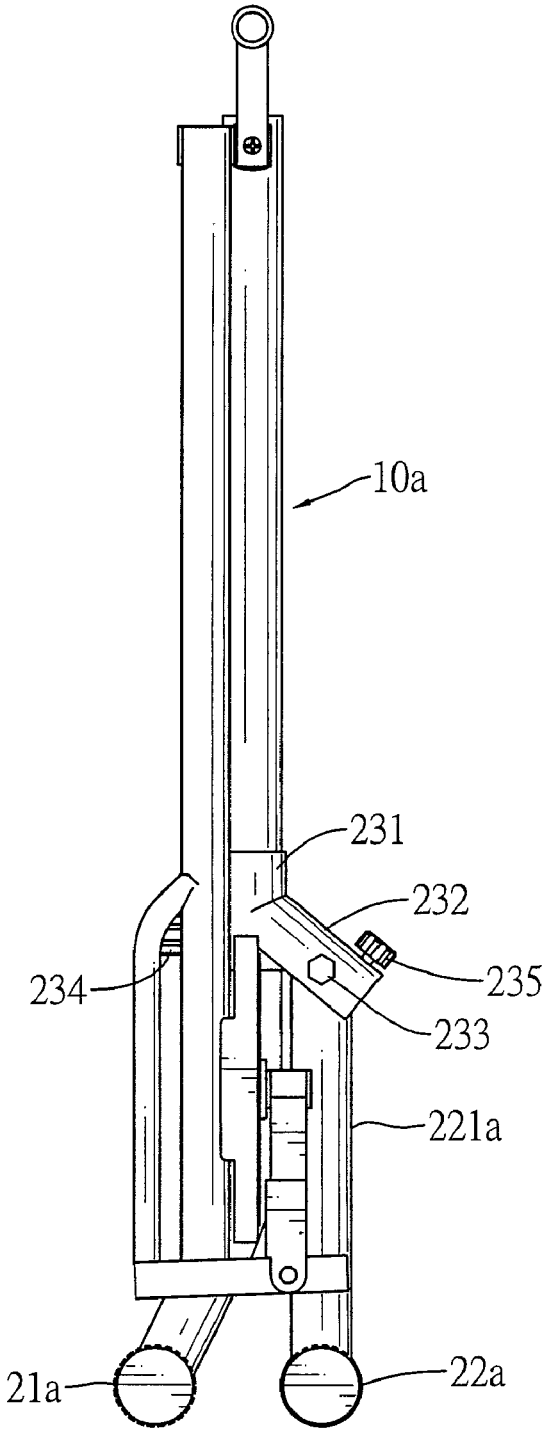
FIG. 14 is a side view of the adductor exerciser in FIG. 13.

With further reference to FIGS. 9 to 11, in a second embodiment of an adductor exerciser in accordance with the present invention, the mounting end (221*a*) has a connector (23). The connector (23) is slidably mounted to the stanchion (10*a*) and has a first sleeve (231) and a second sleeve (232). The first sleeve (231) is slidably mounted to the stanchion (10*a*) and has an outer surface and an optional set screw (234). The set screw (234) is used to fasten the first sleeve (231) to the stanchion (10*a*). The second sleeve (232) is attached to the outer surface of the first sleeve (231), is pivotally connected to the mounting end (221*a*) of the foot (22*a*), forms a bendable joint and has a bolt (233) and an optional set screw (235). The bolt (233) is used to mount the second sleeve (232) to the mounting end (221*a*) of the foot (22*a*). The set screw (235) is used to fasten the second sleeve (232) and the mounting end (221*a*) of the foot (22*a*). By being connected pivotally, the foot (22*a*) may be folded for compact and convenient storage. With further reference to FIGS. 12 to 14, when folding the foot (22*a*), the first sleeve (231) may be unfastened and slide upward to draw the foot (22*a*) more close to the stanchion (10*a*) for more compact storage. The second sleeve (232) renders one of two forking mounting protrusions at the lower end of the stanchion (10*a*).

The crossbar (30) is attached to the upper end of the stanchion (10) and has a middle, two ends and two pivots (31). A user may place their hands on the crossbar (30) for support or to help balance their body. The middle of the crossbar (30) is attached to the upper end of the stanchion (10). The pivots (31) are respectively mounted on the crossbar (30) near the two ends.

Figure 3:
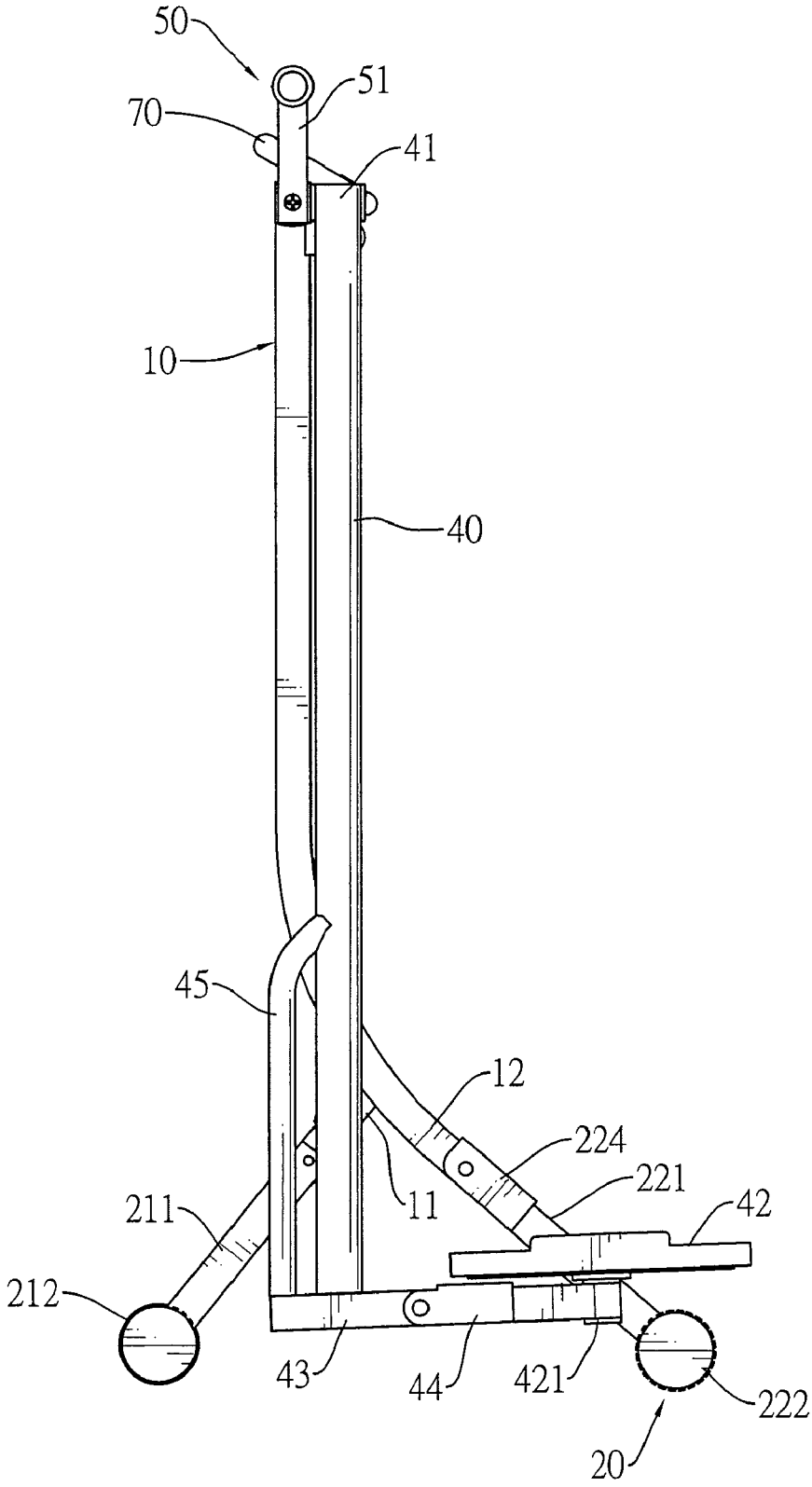
FIG. 3 is a side view of the adductor exerciser in FIG. 1.
Figure 4:
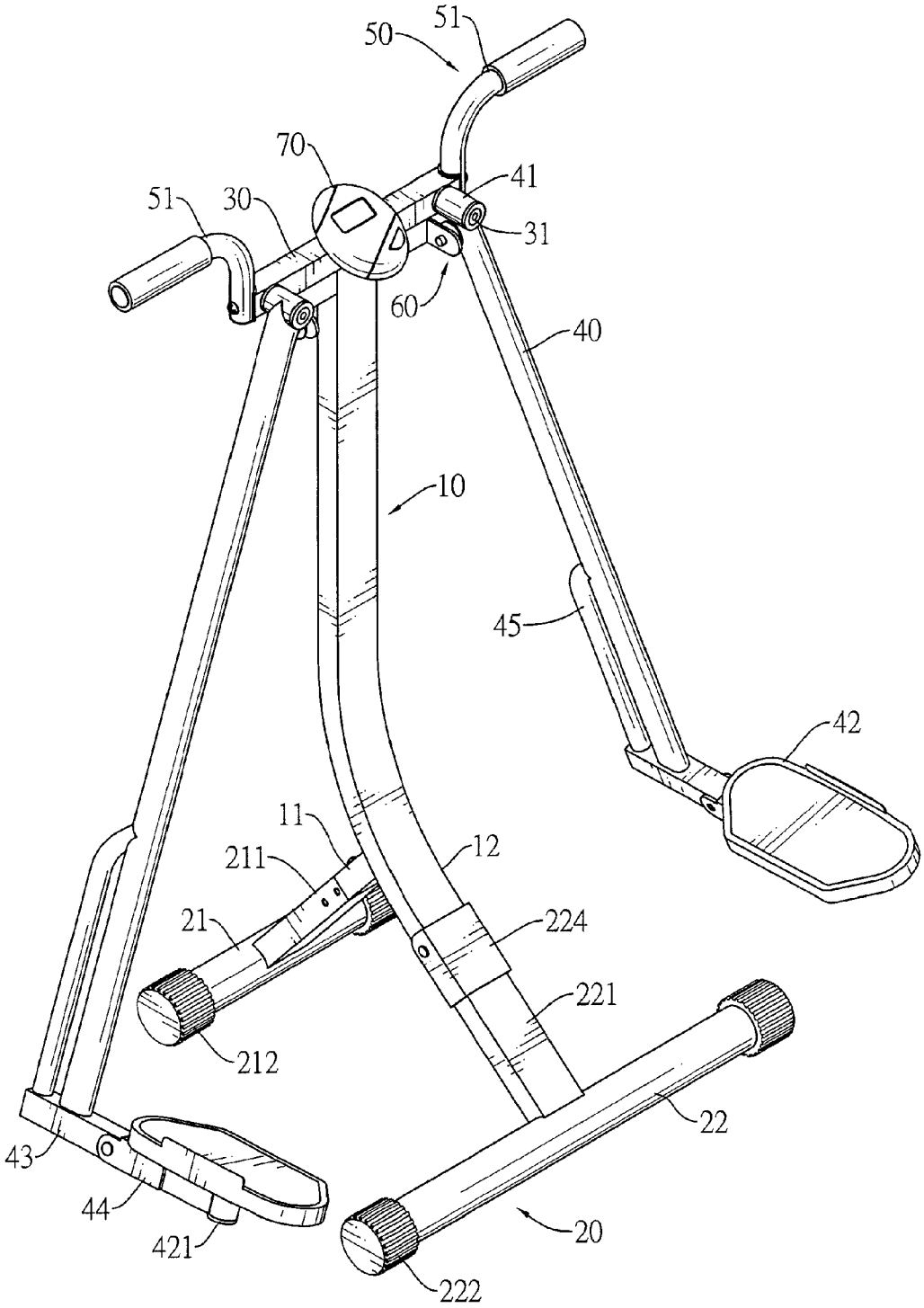
FIG. 4 is an operational perspective view of the adductor exerciser in FIG. 1 showing the legs opening.
Figure 7:
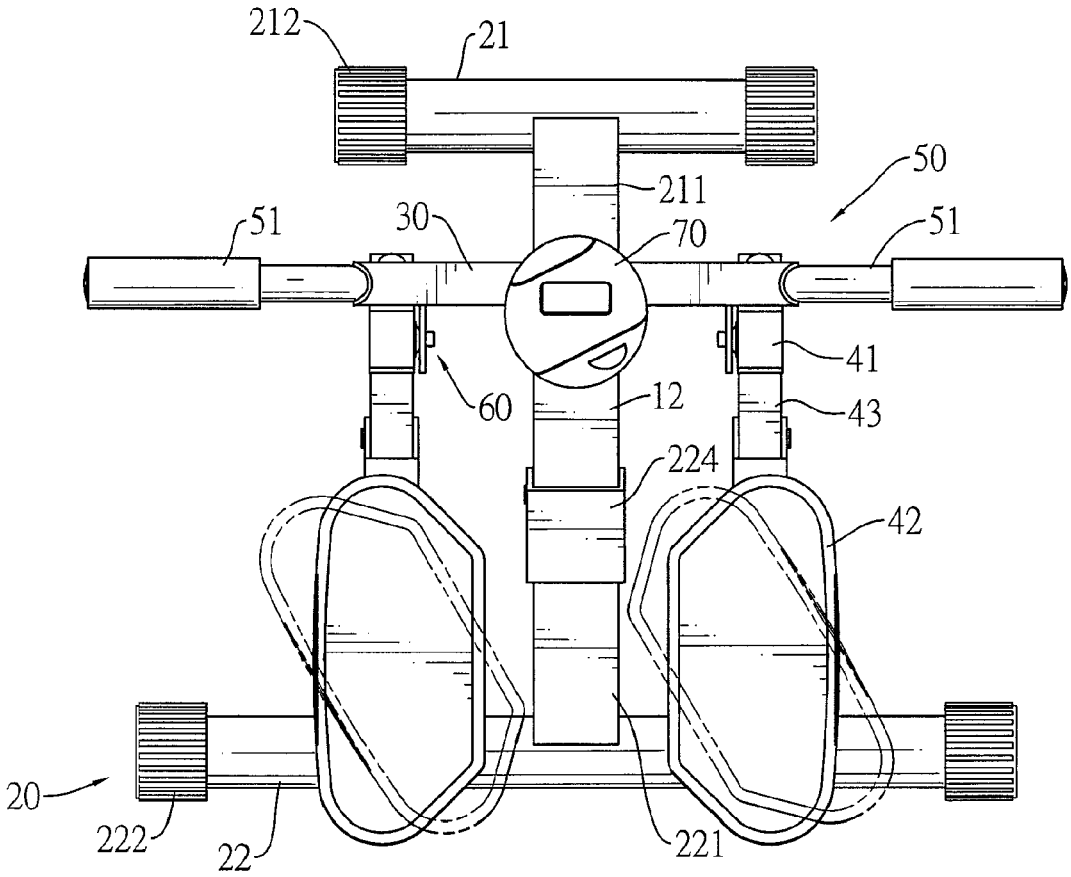
FIG. 7 is an operational top view of the folded adductor exerciser in FIG. 1.
Figure 8:
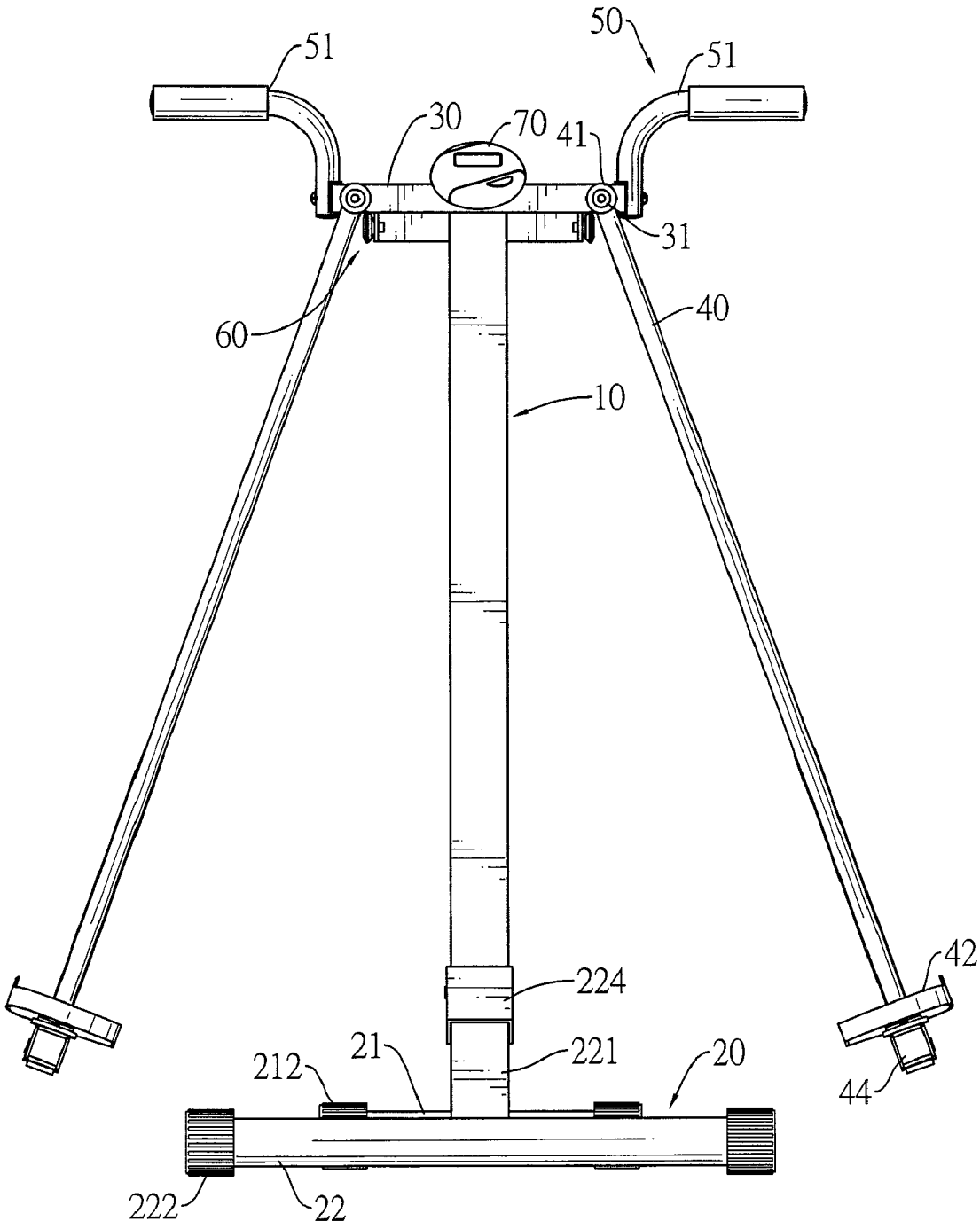
FIG. 8 is an operational rear view of the folded adductor exerciser in FIG. 1.

With further reference to FIGS. 3, 4 and 7, the legs (40) are respectively connected pivotally to the pivots (31) of the crossbar (30) and each leg (40) has a proximal end, a distal end, a sleeve (41), an pedal strut (43), a pedal assembly (42) and a reinforcing rod (45).

The sleeve (41) is formed on the proximal end of the leg (40) and is mounted rotatably on the pivot (31) of the crossbar (30).

The pedal strut (43) is formed on and protrudes perpendicularly from the distal end of the leg (40) and has a rear end.

The reinforcing rod (45) is mounted between the leg (40) and the pedal strut (43) for increased strength.

Figure 5:
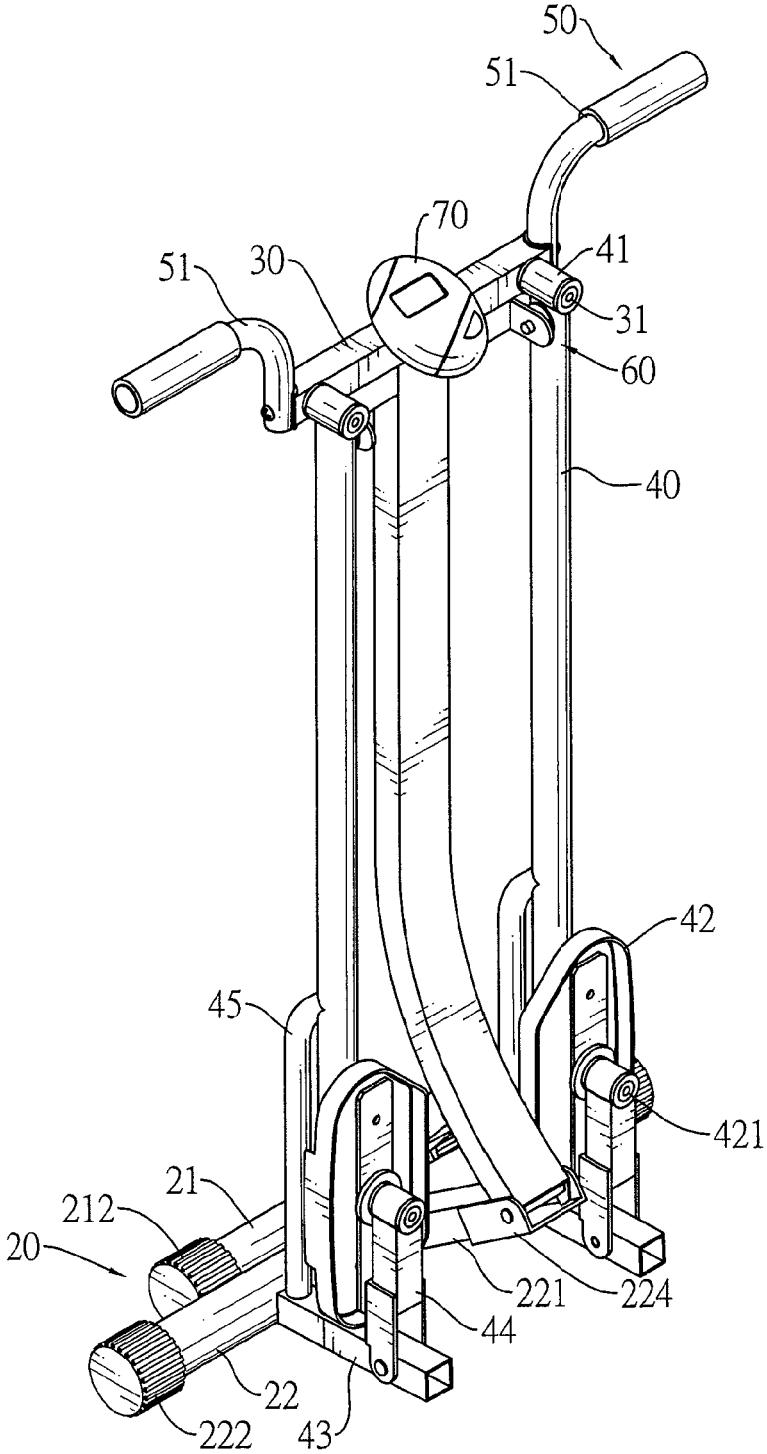
FIG. 5 is a perspective view of the adductor exerciser in FIG. 1, shown folded.
Figure 6:
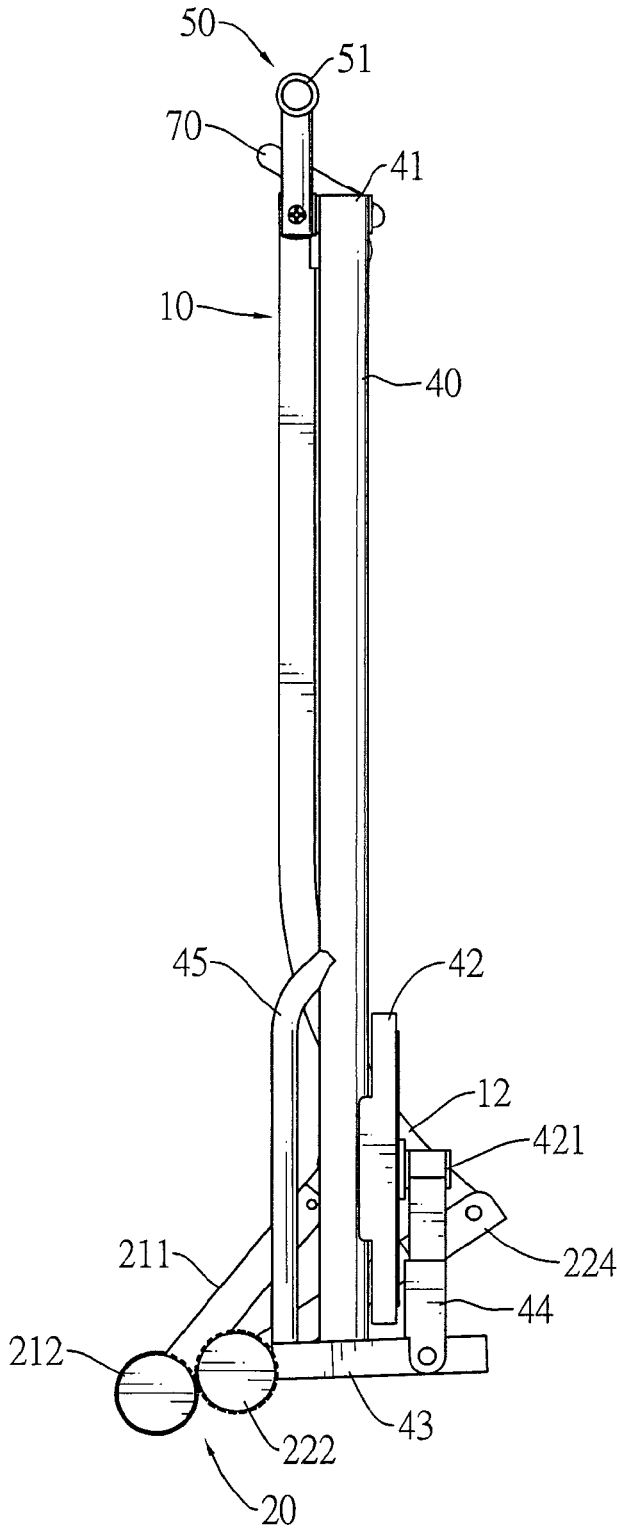
FIG. 6 is a side view of the folded adductor exerciser in FIG. 5.

With further reference to FIGS. 5, 6 and 7, the pedal assembly (42) is mounted rotatably on the pedal strut (43) and may comprise a bottom, a pedal rod (44) and a bottom pintle (421). The pedal rod (44) is mounted pivotally on the pedal strut (43) and may be folded against the leg (40) for compact and convenient storage. The bottom pintle (421) protrudes from the bottom of the pedal assembly (42) and is mounted rotatably in the pedal rod (44).

When using the adductor exerciser, the user may focus on front and rear or side adductor muscles. When exercising side adductor muscles, the user stands on the pedal assemblies (42) facing the stanchion (10). When practicing front and rear adductor muscles, the user rotates the pedal assemblies (42) and faces perpendicular to the stanchion (10).

The handles (50) are attached to the ends of the crossbar (30) and each has an end and a grip (51). The grips (51) are mounted respectively on the ends of the handles (50). The handles (50) allows the user to better balance her or his body by gripping on the grips (51) of the handles (50).

The bumpers (60) are attached to the crossbar (30) respectively adjacent to the pivots (31) and limit rotation of the legs (40).

The computer (70) is mounted on the crossbar (30), and comprises at least one sensor to record and transmit exercising performance to the computer (70) for display and may record time, number of repetitions, heart rate, angle or the like and even recommend programs to the user.

The adductor exerciser is simple to use and may be folded compact for home use. Additionally, no weight block is required so further improving compactness and reducing costs. Importantly, the user does not have to perform embarrassing movements, so the adductor exerciser may be implemented for home use or in commercial gyms Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adductor exerciser having
- a stanchion having
  - an upper end; and
  - a lower end;
- a stand being attached to the lower end of and supporting the stanchion;
- a crossbar being attached to the upper end of the stanchion and having
  - two ends; and
  - two pivots being respectively mounted on the crossbar near the two ends; and
- two legs each being pivotally attached to one of the pivots of the crossbar and each leg having
  - a proximal end;
  - a distal end;
  - a sleeve being formed on the proximal end of the leg and being mounted rotatably on the pivot of the crossbar;
  - a pedal strut being formed on and protruding perpendicularly from the distal end of the leg and having a rear end; and
  - a pedal assembly having a bottom and being mounted rotatably on the pedal strut;
    - a pedal rod being mounted pivotally on the pedal strut; and
    - a bottom pintle protruding from the bottom of the pedal assembly and being mounted rotatably in the pedal rod.

2. The adductor exerciser as claimed in claim 1, wherein
- the lower end of the stanchion forks into two mounting protrusions being formed on and protruding from the lower end of the stanchion; and
- the stand further comprises
  - two feet tubes connected to the lower end of the stanchion and each having two contact ends and a mounting end.

3. The adductor exerciser as claimed in claim 2, wherein each of the two feet tubes has two caps being mounted respectively on the contact ends.

4. The adductor exerciser as claimed in claim 3, wherein each of the two feet tubes extends from the lower end of the stanchion.

5. The adductor exerciser as claimed in claim 3, wherein
- one of the two feet tubes is substantially T-shaped, has two contact ends and a mounting end and is connected pivotally to one of the mounting protrusions of the stanchion; and
- the mounting end of another of the feet tubes is mounted inside one of the mounting protrusions.

6. The adductor exerciser as claimed in claim 5, wherein
- the mounting end of the one of the two feet tubes is firmly mounted to one of the mounting protrusions.

7. The adductor exerciser as claimed in claim 3, further comprising:
- a joint cover pivotally attached to one of the mounting protrusions and having a first end being attached to one of the mounting ends and a second end being pivotally connected to one of the mounting protrusions.

8. The adductor exerciser as claimed in claim 1, wherein the stand further comprises two feet tubes connected to the lower end of the stanchion and each having two contact ends and a mounting end; the adductor exerciser further comprising:

a connector slidably mounted to the stanchion and having a first sleeve being slidably mounted to the stanchion and having an outer surface; and a second sleeve being attached to the outer surface of the first sleeve, being pivotally connected to one of the mounting ends of one of the feet tubes, forming a bendable joint and having a bolt.

9. The adductor exerciser as claimed in claim 8, wherein the first sleeve further has a set screw; and the second sleeve further has a set screw.

10. The adductor exerciser as claimed in claim 1, wherein each leg further comprises a reinforcing rod being mounted between the leg and the pedal strut.

11. The adductor exerciser as claimed in claim 1, further having two handles being attached to the ends of the crossbar and each having an end and a grip being mounted on the end of the handle.

12. The adductor exerciser as claimed in claim 1, further having two bumpers being attached to the crossbar respectively adjacent to the pivots.

13. The adductor exerciser as claimed in claim 1, further having a computer being attached to the crossbar.

* * * * *